US005615631A

United States Patent [19]

Miller et al.

[11] Patent Number: 5,615,631

[45] Date of Patent: Apr. 1, 1997

[54] SKI TOW ASSEMBLY

[75] Inventors: James H. Miller, Holland; Steven R. Isenga, Zeeland, both of Mich.

[73] Assignee: ITC Incorporated, Holland, Mich.

[21] Appl. No.: 522,192

[22] Filed: Aug. 31, 1995

[51] Int. Cl.[6] ..... B63B 21/56

[52] U.S. Cl. ..... 114/253; 164/165; 164/349

[58] Field of Search ..... 114/253, 254, 114/242, 218, 343; D12/317, 162; 164/165, 349

[56] References Cited

U.S. PATENT DOCUMENTS

| | | | |
|---|---|---|---|
| 18,107 | 9/1857 | Seaman . | |
| D. 32,957 | 7/1900 | Lewis . | |
| D. 187,057 | 1/1960 | Griparis . | |
| D. 298,311 | 11/1988 | Greenberg | D12/162 |
| 926,405 | 6/1909 | Gould . | |
| 2,836,141 | 5/1958 | Brydon | 114/218 |
| 2,962,998 | 12/1960 | Long . | |
| 3,055,333 | 9/1962 | Ryan . | |
| 3,233,934 | 2/1966 | Osborn et al. | 114/218 |
| 3,241,200 | 3/1966 | Lirones | 164/349 |
| 3,249,972 | 5/1966 | Watts et al. | 164/165 |
| 3,353,232 | 11/1967 | Brownson . | |
| 3,765,365 | 10/1973 | Gillespie . | |
| 3,890,918 | 6/1975 | Sell . | |
| 3,949,698 | 4/1976 | Sell | 114/253 |
| 4,738,216 | 4/1988 | Camarota et al. . | |
| 4,987,845 | 1/1991 | Camarota . | |
| 5,460,217 | 10/1995 | Sakurai et al. | 164/165 |

OTHER PUBLICATIONS

Photographs ITC Ring Shape Tow with Support Rails Welded Thereto, 1994.
Perko 1994 Sales Brochure.
GEM 1994 Sales Brochure.
Springfield 1994 Sales Brochure.

*Primary Examiner*—Sherman Basinger
*Attorney, Agent, or Firm*—Flynn, Thiel, Boutell & Tanis, P.C.

[57] ABSTRACT

Ski tow assembly for being secured to the transom of a boat. The ski tow fixture has an elongated vertically aligned body. Legs at the opposed ends of the fixture body secure the fixture to the transom. The body is further formed so as to define an elongated generally elliptically shaped opening through which a tow line is inserted. The tow line is coupled over a finger that extends diagonally upwards toward the transom from a small tap attached to a lower part of the fixture and that projects inwardly toward the transom. The assembly includes opposed rails that are mounted to the transom that are coupled to the opposed ends of the fixture by ears that extend outward from the ends of the fixture.

19 Claims, 4 Drawing Sheets

SKI TOW ASSEMBLY

FIELD OF THE INVENTION

This invention relates to a ski tow assembly for removably securing a tow rope to the hull of a boat and, more particularly, to a ski tow assembly that facilitates the quick securing of the rope to the boat, that is economical to manufacture and that has an aesthetically pleasing appearance.

BACKGROUND OF THE INVENTION

In the sport of water skiing, a skier is pulled over the surface of a body of water by a boat with the aid of a tow rope. In order to couple the tow rope to the boat, a ski tow fixture is often attached to the transom of the boat and the tow rope is hooked around the ski tow.

A number of different ski tows have been employed for securing a tow rope to a boat. Some ski tows include a ring-shaped body that is secured to the boat so as to extend rearwardly from the transom. Integral with the ring body is a finger that is directed forward toward the transom. The tow rope is secured to the boat by placing a loop formed in the rope over the finger. These fixtures have proven quite useful because they provide a relatively simple mechanism for coupling the tow rope to the fixture. However, these fixtures have several disadvantages. In particular, with some of these assemblies, if the tow rope goes slack, the loop can sometimes work itself off the finger and free of the ski tow. Once this occurs, it is necessary to spend time reattaching the rope to the ski tow. Moreover, many of these ski tows are fabricated by welding or otherwise securing the finger to the outer surface of the ring body. It has been found that precision welding of the finger to the ring body is a difficult task that all too frequently is performed incorrectly or results in final assembly with unattractive appearance. Consequently, the cost of manufacturing these ski tows tends to be relatively high owing to the cost of precision welding the units and the taking into account the waste that results from periodic miswelding.

Another basic type of ski tow is one that has a generally U-shaped body that extends rearward from the transom to which it is attached. This type of ski tow is provided with a center finger that extends inward toward the transom. The tow rope is coupled to this fixture by wrapping the loop formed in the rope around both the body and the finger. These assemblies have proved useful in that when rope the is attached to one, it seldom works itself free of the ski tow fixture. A disadvantage of these fixtures is that care must be taken to properly wrap the tow rope around both the fixture body and associated finger in the correct pattern. If the rope is not properly wrapped around the fixture, there is a possibility that the rope can work itself free. Moreover, these fixtures, like those tows with ring shaped bodies, are often manufactured by welding the finger to the outer surface of the associated body. Thus, as with ski tows formed with ring shaped bodies, owing to the periodic manufacture of units with either structural or aesthetic defects, the manufacturing costs of these ski tows can be higher than one would normally expect.

Moreover, many ski tow fixtures are designed to serve as more than just as an actual tow rope coupling member. Often the ski tow is employed as a horizontally oriented support or stanchion to secure a rail located around the transom to the boat. These rails are often secured to boats used to tow water skiers to function as handgrips that make it easier for skiers to enter and leave the water. Most rails have a rounded cross-sectional profiles and are typically secured to ski tow fixtures with ring shaped bodies. Currently, a rail is typically secured to ski tow by simply flattening the ends of the tubing forming the rail and then welding the tubing to the side of the ski tow. A disadvantage of these assemblies is that no matter how carefully one flattens the tubing or tries to weld it to the ski tow fixture, the final assembled product tends to have an uneven, unattractive appearance. Consequently, a considerable amount of time is often spent trying to properly fabricate these assemblies so that they are both structurally sound and have at least some aesthetically pleasing qualities.

SUMMARY OF THE INVENTION

This invention relates to a new ski tow fixture useful for coupling a tow rope to a boat that facilitates the ready coupling of the rope to the tow, that prevents the tow rope from working itself free of the fixture, that can provide an aesthetically pleasing structural appearance for a tow used as a complementary rail support and that can be economically manufactured.

BRIEF DESCRIPTION OF THE DRAWINGS

The invention as pointed out with particularity in the appended claims. The above and further advantages of the invention may be better understood by referring to the following description, taken in conjunction with the accompanying drawings, in which:

DETAILED DESCRIPTION

Figure 1:
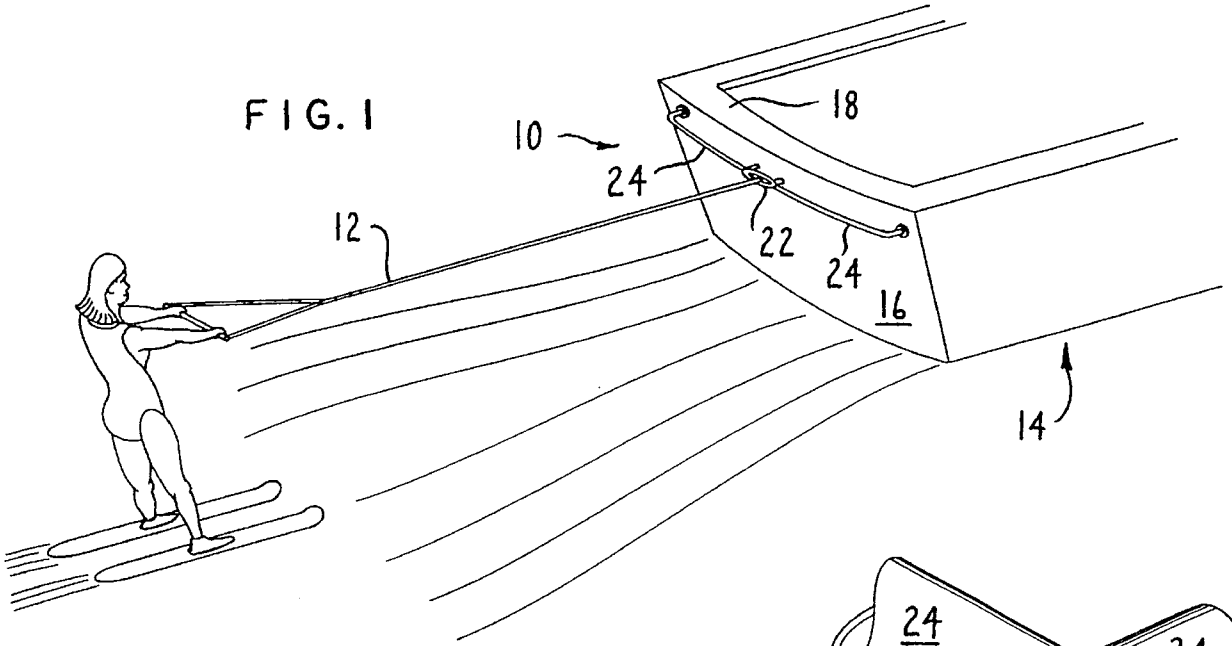
FIG. 1 is a perspective view illustrating how a ski tow assembly of this invention is used to secure a tow line to a boat.
Figure 1A:
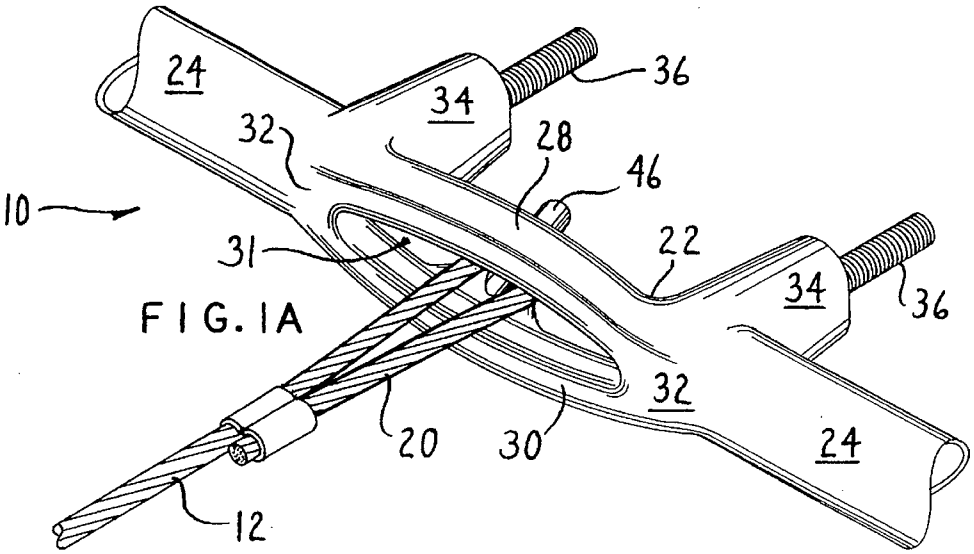
FIG. 1A is a close up perspective view of the ski tow of FIG. 1.
Figure 2:
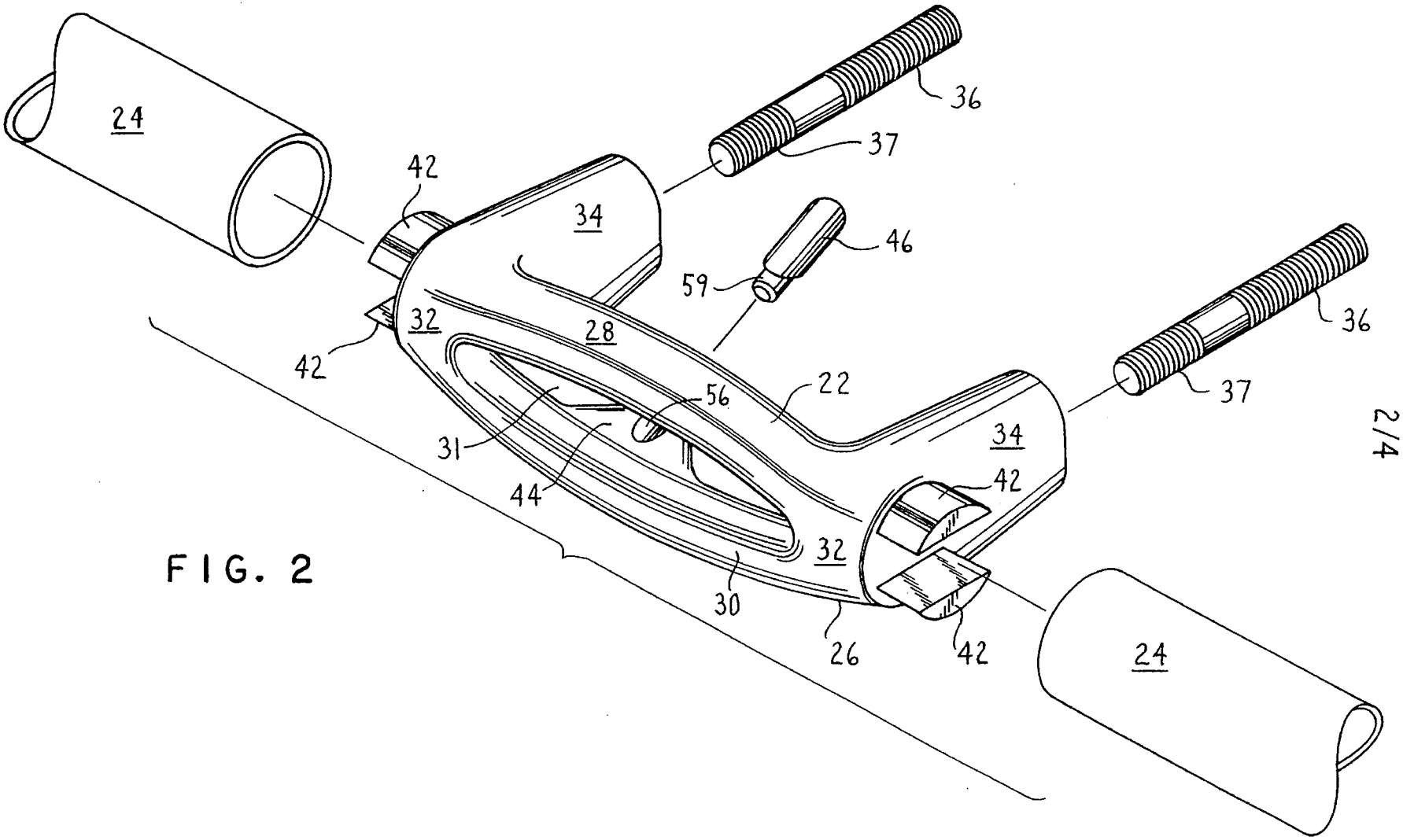
FIG. 2 is a partial exploded view illustrating the features of the rail and ski tow of the ski tow assembly of FIG. 1.

FIGS. 1, 1A and 2 illustrate how a ski tow assembly 10 of this invention is used to attach a ski tow rope 12 to a boat 14. The assembly 10 is secured to the transom 16 of the boat 14 a slight distance below the gunwale 18. The tow rope 12 is formed with a looped end 20 that, as discussed hereinafter, is secured to the assembly 10. Ski tow assembly 10 of this invention includes a ski tow 22 to which the tow rope 12 is attached and a pair of rails 24 that are coupled to the opposed ends of the ski tow and that extend longitudinally away therefrom.

Ski tow 22 includes a body 26 with an upwardly bowed upper rib 28 that is joined at the ends thereof to a downwardly bowed lower rib 30. Ribs 28 and 30 define an elongated, generally elliptically shaped body opening 31 and is aligned along the longitudinal axis of the ski tow 22. In some preferred versions of the invention, ski tow body 26 is formed so that opening 31 has a horizontal length of between 2.50 inches and 4.00 inches and in more preferred versions of the invention, opening 31 a length of approximately 3.25 inches. Ski tow body 26 is further formed so that opening 31 has a maximum vertical width of between 0.50 and 1.25 inches and in more preferred versions of the invention, a maximum width of approximately 0.75 inches.

Ribs 28 and 30 meet at opposed body end sections 32. The fixture 22 is secured to the boat transom 16 by a pair of legs 34. Each leg 34 extends inward toward the transom 16 from one of the end sections 32. Threaded fastening bolts 36 that extend out from the free ends of the legs 34 facilitate the mechanical coupling of the fixture to the boat 14. Bolts 36 have threaded stem sections 37 that are adapted to be secured into threaded openings 38 (FIG. 4C) formed inside the legs 34. The bolts 36 extend through openings formed in the transom 16; complimentary fasteners fitted over the free ends of the bolts hold the ski tow 22 in place, (transom openings and fasteners not illustrated). Fixture body end sections 32 are each provided with a pair of outwardly directed, spaced apart, symmetrically arranged ears 42. Each ear 42 is in the form of solid piece that has an outer surface with a circular profile.

Figure 3:
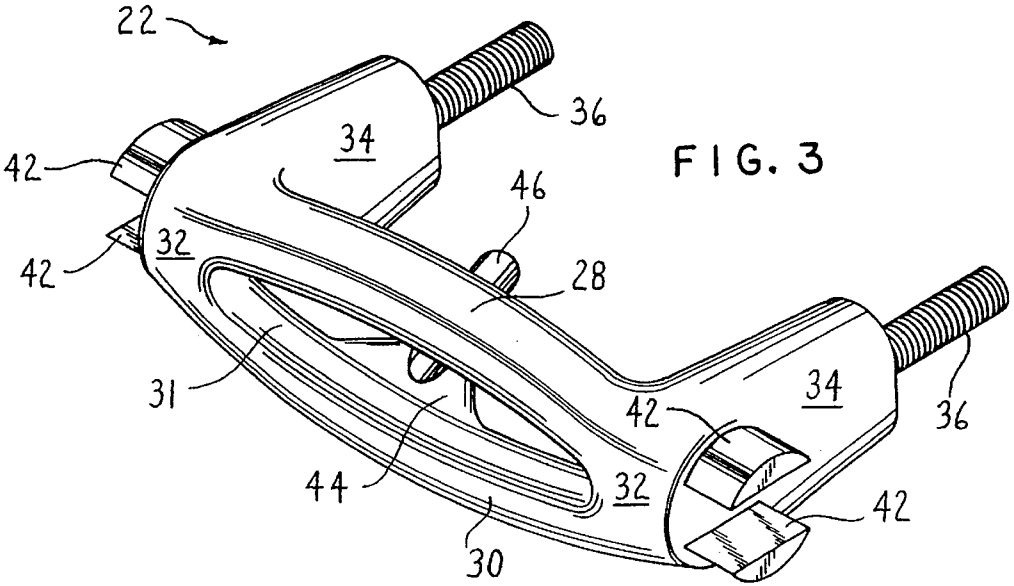
FIG. 3 is a perspective view of the ski tow of FIG. 1.
Figure 4C:
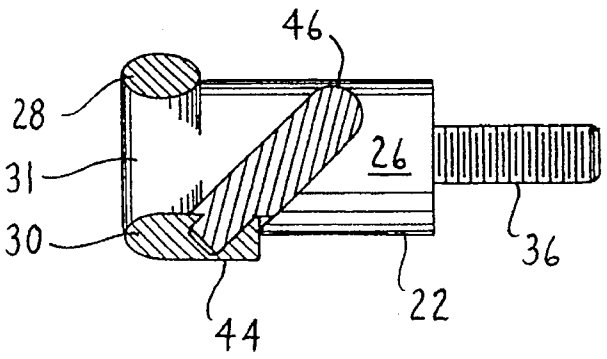
FIGS. 4A–4C illustrate one method of manufacturing the ski tow of this invention.
Figure 4A:
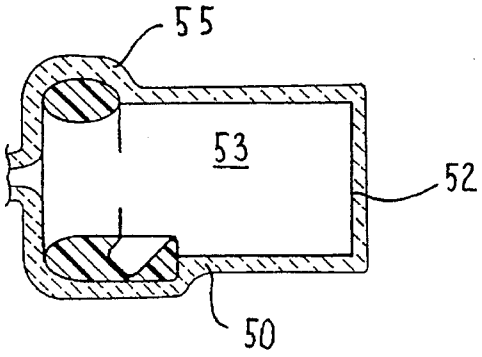
Figure 4B:
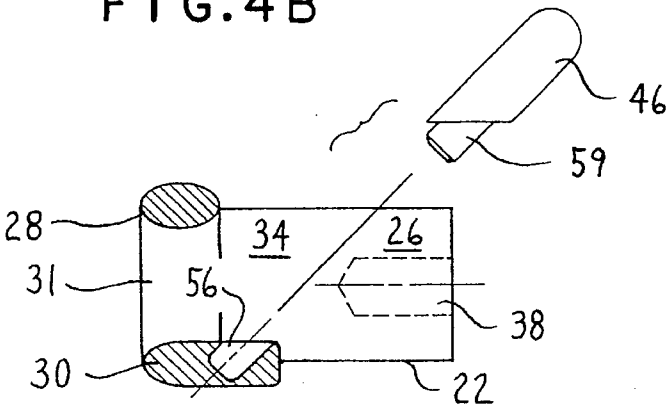

Body lower rib 30 is formed with a tab 44, best depicted in FIGS. 3 and 4B, that extends inward toward the transom 16. In the depicted version of the invention, tab 44 has generally the shape of a truncated triangle and is positioned so the base portion thereof is secured to the adjacent lower rib 30. In some preferred versions of the invention, tab 44 extends between 0.25 and 0.50 inches rearward from the ends of the ribs 28 and 30 and in more preferred versions of the invention, the tab extends approximately 0.35 inches rearward from the ribs. A finger 46 extends diagonally upward toward the gunwale 18 from the end section of the tab 44. This finger has a rounded head and is dimensioned so that the tip is located above the lower surface of upper rib 28 that defines the top of body opening 31. In some preferred versions of the invention, finger 44 is formed and positioned to extend approximately 0.10 inches above the lower surface of upper rib 28.

In order to minimize the possibility that the rope loop 20 will slip off the finger 46, ski tow 22 is further dimensioned so that the end tip of the finger is located relatively close to the transom 16. In some preferred versions of the invention, ski tow 22 is shaped so that finger 46 is between 0.375 and 0.625 inches from the adjacent surface of the transom 16. In more preferred versions of the invention, finger 46 is spaced approximately 0.500 inches from the transom 16. The position of the finger 46 is established by selectively dimensioning the length of the tab 44 from which the finger extends and/or the length of the legs 34 that hold the ski tow body 26 in position.

Rails 24 are formed of hollow tubular members. In the depicted version of the invention, rails 24 have a circular cross-sectional profile. In alternative versions of the invention, rails 24 may have oval or elliptical cross-sectional profiles. Rails 24 are shaped so that the ends thereof opposite the ends attached to the ski tow 24 are curved inwardly so that they can be directly attached to the boat transom 16 by conventional securement sub-assemblies (not illustrated). When the ski tow assembly 10 of this invention is assembled, the open ends of the rails 24 adjacent the ski tow 22 are seated over the ears 42. The stabilizing securement provided by the ears 42 facilitates the welding of the rails 24 to the ski tow 22. In some versions of the invention, ears 42 are spaced apart a sufficient distance to ensure some degree of compression fit between the tow 22 and the ears. Rails 24 may also be welded or otherwise permanently secured to the ski tow 22.

Some preferred versions of the ski tow 24 of this assembly are manufactured by investment casting. In this method of manufacture, a sand mold 50 having a cavity 52 in the shape of the basic tow body 24 and tab 44 is formed. Mold 50 is formed by first dipping a wax casting 53 in the shape of tow body 26 in a sand slurry. A stucco coating is then applied to the sand in order to form a hard mold 55 around the wax casting 53. Once the sand has hardened, the wax is drained from the mold to define the cavity 52 (FIG. 4A).

Once mold 50 is formed, molten metal is poured into the cavity 52 to form the basic tow body 26 with integral tab 44 (FIG. 4B). As part of this process, tab 44 may be formed with a diagonally extending bore 56 that has an opening located rearward of the adjacent lower rib 30. Once the body 26 is formed, finger 46 is inserted into bore 56. In some preferred versions of the invention, finger 46 is formed with a reduced diameter stud section 59 designed to be secured in bore 56. Once finger 46 is fitted into bore 56, the finger is welded or otherwise permanently secured to the tab 44. The threaded bores 38 are then formed in the legs 34 and the bolts 36 secured in the bores 38 (FIG. 4C).

When the ski tow assembly 10 of this invention is attached to a boat 14, it provides both a coupling for securing a tow line 12 to the boat and hand holds to assist a person getting into or out of the boat. Often, the tow line 12 is formed of polyethylene or other synthetic material. Over time, the loop 20 formed in the line 12 develops a flat profile. The elongated profile of the opening 31 formed in ski tow 22 facilitates the relatively easy insertion of the flattened loop 20 into the fixture. Once the tow line loop 20 is passed through fixture body 26, the loop readily moves up over the finger 46. After the tow line loop 20 passes over the finger 46, the loop then locks in place around the finger. The relatively narrow spacing between the ribs 28 and 30 restricts the up and down movement of the tow line as the rope vibrates while being pulled through the water. The damping of the rope movement and the extension of finger 46 above the top of opening 31 substantially reduce the possibility that the rope will work itself over the top of the finger 46 and free from the ski tow assembly 10. Moreover, the end tip of the finger 46 is located relatively close to the boat transom 16. The feature of the ski tow assembly 10 of this invention minimizes the ability of the rope to move forward so as to further lessen the likelihood that the rope will be able to work itself free from the tow.

The rails 24 of assembly 10 serve as handholds for persons entering and leaving the boat. Since the rails are secured to the ski tow 22, the ski tow provides a structural connection to between the boat 12 and the rails. Moreover, the ski tow ears 42 provide a convenient high strength means for coupling the rails to the ski tow that does not require the bending of the rails which could adversely effect the structural strength of these components and that can detract from the aesthetic of the ski tow assembly 10. The pleasing visual presentation of this invention is also fostered by the elliptical profile of the ski tow body 26. This is because the long and narrow shape of the body makes the ski tow 24 appear as if it is integrated into the rail 24.

Still another feature of the ski tow assembly 10 of this invention is that the components of the tow that are welded or otherwise secured together are formed with complementary coupling members. The ears 42, facilitate the coupling of the rails 24 to the ski tow 22. The ski tow body 26 is formed with a bore 56 in which the finger 46 is seated prior to permanent securement of the finger. These coupling sub-assemblies make it relatively easy to quickly, accurately, aesthetically and economically permanently attach the individual components of this invention together to form the integral assembly 10. Moreover, since the coupling sub-assemblies ensure accurate final placement of the components, the number of assemblies inaccurately assembled is substantially eliminated so as to further reduce the overall costs of manufacturing the ski tow assembly 10 of this invention.

Figure 5:
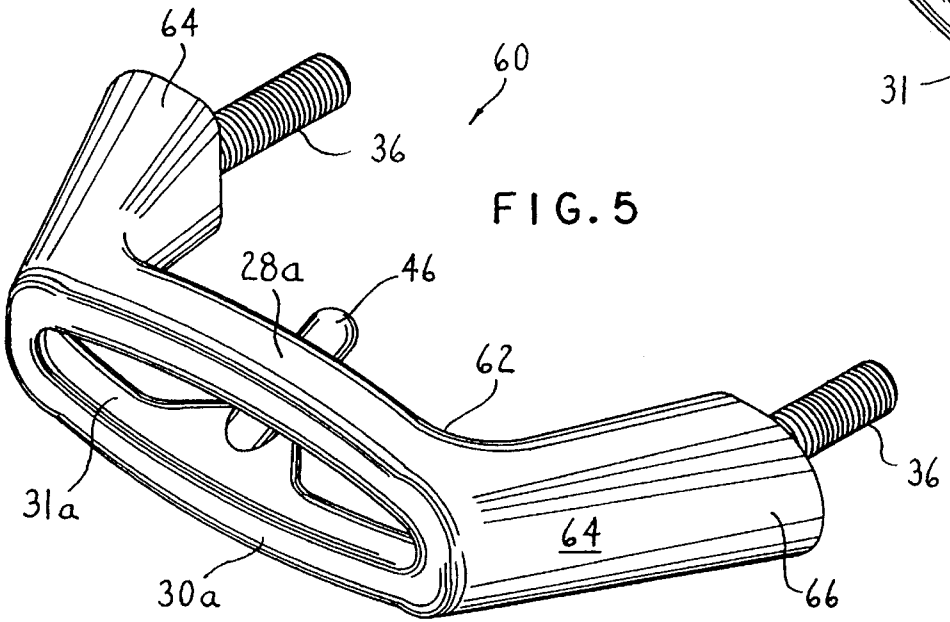
FIG. 5 is a perspective view of an alternative ski tow fixture of this invention.

FIG. 5 illustrates an alternative ski tow assembly 60 of this invention. Assembly 60 includes body 62 with upper and lower ribs 28*a* and 30*a* that define an elongated opening 31*a*. A platform 44*a* with inwardly and upwardly extending finger 46*a* mounted thereon is secured to the lower inside edge of the lower rib 30*a*.

Assembly 60 includes a pair of legs 64 each of which is attached to a separate end of the body 62. Each leg 64 is shaped to extend horizontally a short distance away from the body opening 31*a*. Bolts 36 extend away from the ends of the legs 64. Each leg 64 is further formed with a curved outer surface 66 which extends from the open end of the assembly body 62 to the free end of the leg 64 attached to the boat transom 16.

Ski tow 60 of this invention can be manufactured by investment casting as described with respect to the first embodiment of this invention.

Assembly 60 of this invention is constructed to be secured to a transom 16 of a boat 14 where it is either difficult or undesirable to provide a ski tow with rails. The relatively flat horizontal profile of the ski tow body 62 and the curved profile of the legs 64 facilitate its use, not just as a tow rope coupling, but also as a hand hold to facilitate entry into and exit from the water.

It should be understood that the foregoing description is for the purposes of illustration only and alternative embodiments of this invention are possible without departing from the scope of the claims. For example, it should be recognized that other versions of this invention may look different from the illustrated and described versions. Thus, it may be possible to provide a system for coupling the body 60 with the projecting legs 64, so that it can be used to provide support for complementary rails. Furthermore, it should also be recognized that members other than the ears may be employed as coupling members for providing a mechanical connection between the fixture 22 and the associated rails 24. For example, in some versions of the invention, it may be desirable to form the body end sections 32 of the fixture 22 with openings into which the rails are inserted. With these versions of the invention, it may further be desirable to provide threaded bores to facilitate the instillation of set screws that firmly lock the rails in place.

Moreover, while in one preferred version of this invention, the finger 46 is formed separately from the investment cast body 26, that need not always be the case. In alternative preferred versions of this invention it may be desirable to form the ski tow finger 46 integrally with the body 26 when the body is investment cast. An advantage of forming the ski tow 22 as an integral unit is that it eliminates the need to have to later weld the finger to the body.

It should also be recognized that while it some preferred versions of the body of this invention be formed by investment casting that it may be possible to form the invention by other means. Thus, it may be desirable to form the body 26 and legs 34 out of separate units that are welded together or mechanically coupled together, and are then installed on a boat 14. This latter assembly may be desirable in circumstances when the elements forming the assembly 10 of this invention are sold as a kit of interchangeable pieces to allow an individual to custom construct the assembly for his/her particular needs.

Thus, although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A ski tow assembly to facilitate the coupling of a tow line to transom of a boat, said assembly including:

at least one rail adapted to extend horizontally along transom of a boat; and a ski tow fixture mechanically coupled to said rail, said ski tow fixture including: a horizontally oriented elongated body, said body being shaped so as to form a horizontally aligned elongated opening having a selected vertical width and having a pair of opposed ends; a finger attached to a lower section of said body, said finger adapted to be positioned so as to be directed upwardly and towards a transom of a boat and having a length so as to extend to a height at least equal to the vertical width of said opening formed in said body; a fastening member attached to one said fixture body end for coupling said at least one rail thereto; and legs attached to said opposed ends of said body, each said leg adapted to extend from said body to a transom of a boat.

2. The ski tow assembly of claim 1, wherein said legs are integrally formed with said fixture body.

3. The ski tow assembly of claim 2, wherein: said fixture is formed with opposed upper and lower ribs which define said opening in said body of said fixture; said lower rib is formed with a tab that is adapted to extend inward toward a transom of a boat from said fixture opening; and said finger attached to said tab so as to extend upwardly therefrom as so as to be located inward toward a transom of a boat from said lower rib.

4. The ski tow assembly of claim 3, wherein said finger of said fixture is formed to extend above said ski tow fixture body opening.

5. The ski tow assembly of claim 2, wherein said rail is formed with an open end and said ski tow fixture body is formed with at least one ear dimensioned to be fitted in said rail open end.

6. The ski tow assembly of claim 1, wherein: said fixture is formed with opposed upper and lower ribs which define said opening formed in said body of said fixture; said lower rib is formed with a tab that is adapted to extend inward toward a transom of a boat from said fixture opening; and said finger is attached to said tab so as to extend upwardly therefrom so as to be located inward toward a transom of a boat from said lower rib.

7. The ski tow assembly of claim 6, wherein said finger of said fixture is formed to extend above said ski tow opening formed in said body of said fixture.

8. The ski tow assembly of claim 6, wherein said rail is formed with an open end and said ski tow fixture body is formed with at least one ear dimensioned to be fitted in said rail open end.

9. A ski tow assembly of claim 8, wherein said ski tow fixture is formed with two said ears, said ears being spaced apart from each other and being dimensioned to be fitted in said open end of said rail.

10. The assembly of claim 6, wherein said body of said fixture is formed so that said opening formed in said body has a generally elliptical shape.

11. A ski tow fixture for attaching a tow rope to a boat, the boat having a transom, said ski tow fixture including: a horizontally oriented elongated body, said body being shaped so as to form a horizontally aligned elongated opening having a selected maximum vertical width and to have a pair of opposed ends; a finger attached to a lower section of said body, said finger being adapted to extend upwardly and towards a transom of a boat and having a length so as to extend to a height at least equal to the maximum vertical width of said body opening; a pair of legs attached to said opposed ends, each said leg adapted to extend from said body to a transom of a boat; and ears integral with said body and located at said opposed ends of said body so as to extend away from said opening formed in said body, each said ear adapted to receive a hand rail so that hand rails can be coupled to said ski tow fixture.

12. The ski tow fixture of claim 11, wherein: said fixture is formed with opposed upper and lower ribs which define said opening in said body of said fixture; said lower rib is formed with a tab that extends inward toward transom of a boat from said fixture opening; and said finger is attached to said tab so as to extend upward therefrom and further is adapted to be positioned towards a transom of a boat.

13. The ski tow fixture of claim 12, wherein said finger is formed to extend above said opening in said body.

14. The ski tow fixture of claim 12, wherein said legs are formed to extend away from said body opening.

15. The ski tow fixture of claim 12, wherein each said opposed end of said body is provided with two spaced apart ears, each said pair of ears being adapted to receive a hand rail.

16. A ski tow fixture manufactured according to the steps of:

forming a wax casting of the tow fixture body, said wax casting being formed to define a body that has opposed ends and opposed upper and lower ribs that are integrally connected at said opposed ends of said body and that are spaced apart to define a body opening having a width, a tab that extends from said lower rib, a finger that extends from said tab toward said upper rib and that has a height at least equal to said body opening width and a coupling member at each said opposed end of said body, each said coupling member adapted to receive a rail;

forming a sand mold around said wax casting;

draining said wax from said sand mold to define a cavity in said mold; and pouring molten metal into the mold cavity so as to form said tow fixture body, including said finger thereof as an integral unit.

17. The ski tow of claim 16, wherein said wax casting is formed so that said finger extends diagonally away from said body opening.

18. The ski tow of claim 16, wherein during said wax casting, said ends of said body are each formed with at least one outwardly directed ear, said ears functioning as said coupling members.

19. A ski tow of claim 18, wherein said wax casting is formed so that two spaced apart ears formed at each said opposed end of said body, each said pair of ears being adapted to receive a rail.

* * * * *

UNITED STATES PATENT AND TRADEMARK OFFICE

CERTIFICATE OF CORRECTION

PATENT NO. : 5 615 631

DATED : April 1, 1997

INVENTOR(S) : James H. MILLER, et al.

It is certified that error appears in the above-indentified patent and that said Letters Patent is hereby corrected as shown below:

Column 6, line 9; after "to" insert ---a---.

line 10; after "along" insert ---a---.

line 33; delete "as" (second occurrence).

Column 7, line 17; after "toward" insert ---a---.

Column 8, line 21; after "said"

insert ---forming of the---.

Signed and Sealed this

Twenty-sixth Day of August, 1997

*Attest:*

Bruce Lehman

BRUCE LEHMAN

*Attesting Officer*

*Commissioner of Patents and Trademarks*